US009642457B1

(12) United States Patent
Halfen et al.

(10) Patent No.: US 9,642,457 B1
(45) Date of Patent: May 9, 2017

(54) ADJUSTABLE FRAME FOR HANGING FOLDERS

(71) Applicant: Smead Manufacturing Company, Hastings, MN (US)

(72) Inventors: Marvin J. Halfen, Hastings, MN (US); Tony Kramer, Woodbury, MN (US); Daniel Darst, Zimmerman, MN (US); Dan Johnson, Minneapolis, MN (US)

(73) Assignee: Smead Manufacturing Company, Hastings, MN (US)

( * ) Notice: Subject to any disclaimer, the term of this patent is extended or adjusted under 35 U.S.C. 154(b) by 33 days.

(21) Appl. No.: 14/750,238

(22) Filed: Jun. 25, 2015

(51) Int. Cl.

| | |
|---|---|
| ***A47F 5/00*** | (2006.01) |
| ***A47F 5/08*** | (2006.01) |
| ***A47F 7/16*** | (2006.01) |
| ***A47B 63/00*** | (2006.01) |
| ***A47B 45/00*** | (2006.01) |
| ***B42F 15/00*** | (2006.01) |
| ***A47F 7/14*** | (2006.01) |

(52) U.S. Cl.
CPC ..... *A47B 63/00* (2013.01); *A47B 45/00* (2013.01); *A47F 7/143* (2013.01); *B42F 15/007* (2013.01)

(58) Field of Classification Search
CPC ..... A47B 63/00; A47B 45/00; A47B 61/02; A47B 46/00; B42F 15/06; B42F 15/066; B42F 17/02; B42F 15/0035; B42F 21/065; B42F 15/0011; B42F 15/0094; B42F 15/007; B42F 15/0082; B42F 15/00; A47F 7/163; A47F 7/143; A47F 7/16; A47F 7/175; A47F 7/145
USPC ..... 211/45, 50, 46, 94.02, 126.13; 312/183, 312/184; 229/67.1
See application file for complete search history.

(56) References Cited

U.S. PATENT DOCUMENTS

| | | | | | |
|---|---|---|---|---|---|
| 2,336,802 | A * | 12/1943 | Posner | B42F 15/0094 | 211/162 |
| 3,788,718 | A * | 1/1974 | Bjorn | A47B 63/00 | 211/184 |
| 3,885,765 | A * | 5/1975 | Richards | A47B 13/06 | 211/182 |
| 3,944,080 | A * | 3/1976 | Hansen | B42F 15/0094 | 211/46 |
| 3,999,663 | A * | 12/1976 | Walter | B42F 15/0094 | 211/175 |
| 4,030,610 | A * | 6/1977 | Alexander | B42F 15/0094 | 211/162 |
| 4,049,127 | A * | 9/1977 | Alexander | B42F 15/0094 | 211/184 |
| 4,091,933 | A * | 5/1978 | Alexander | B42F 15/0094 | 211/204 |
| 4,176,753 | A * | 12/1979 | Godfrey | B42F 15/0094 | 211/182 |
| 4,236,770 | A * | 12/1980 | Moore | B42F 15/0035 | 229/67.2 |

(Continued)

*Primary Examiner* — Jennifer E Novosad
(74) *Attorney, Agent, or Firm* — Altera Law Group, LLC

(57) ABSTRACT

A hanging file folder frame is disclosed in several embodiments one of which is constructed of three segments. Two frames are joined together by rails. The frame includes a slot of a particular profile and the rails have a similar profile to slide into the slots. On the bottom of the frame are recesses sized to receive a portion of a wireframe leg. The leg is prevented from being ejected from the frame by a spanning flange which bridges part of the recess and confines a part of the leg between the recess walls and the flange.

15 Claims, 17 Drawing Sheets

(56) References Cited

U.S. PATENT DOCUMENTS 4,312,453 A * 1/1982 Barber ..... B42F 15/0058 211/16
4,475,657 A * 10/1984 Albery ..... B42F 15/0094 211/189
4,526,277 A * 7/1985 Snowden ..... B42F 15/0094 211/46
4,527,694 A * 7/1985 Bolt ..... B42F 15/0094 211/162
4,658,966 A * 4/1987 Broek ..... B42F 15/06 211/46
4,666,047 A * 5/1987 Fletcher ..... B42F 15/0088 211/162
4,726,635 A * 2/1988 Rariden ..... B42F 15/0094 220/532
4,887,873 A * 12/1989 Goedken ..... A47B 88/00 312/184
5,060,808 A * 10/1991 Engman ..... B42F 15/0094 211/189
5,205,626 A * 4/1993 Fotioo ..... B42F 15/0094 211/189
5,396,995 A * 3/1995 Turek ..... B42F 15/0094 211/189
5,405,020 A * 4/1995 Fotioo ..... B42F 15/0094 211/189
5,515,980 A * 5/1996 Fotioo ..... B42F 15/0094 211/189
6,279,762 B1 * 8/2001 Buchalter ..... B42F 15/0094 211/189
6,364,133 B1 * 4/2002 Sheng ..... B42F 15/0094 211/189
6,811,041 B1 * 11/2004 Juliano ..... B42F 15/04 211/124
6,938,784 B2 * 9/2005 Yang ..... A47B 88/00 211/87.01
2003/0038565 A1 * 2/2003 Walla ..... A47B 88/20 312/184
2007/0251897 A1 * 11/2007 Chang ..... B42F 15/0094 211/46

* cited by examiner

ADJUSTABLE FRAME FOR HANGING FOLDERS

BACKGROUND OF THE DISCLOSURE

Field of the Disclosure

The present invention broadly relates to hanging file systems for desk drawers or the like. More particularly, it relates to an improved hanging file system and a kit for erecting the system that includes a frame adapted to be varied in length and width for holding conventional letter size or legal size hanging files in desk drawers.

Description of the Related Art

The primary disadvantages of most previous hanging file folders systems is a lack of stability or, conversely rigidity, either of which makes the handling of heavy files difficult for the frame to structurally sustain. Bjorn U.S. Pat. No. 3,788,718 discloses a rigid frame with slip button type connection means for attaching the sides and the ends together. See also Barber U.S. Pat. No. 4,312,453, Broek U.S. Pat. No. 4,658,966, U.S. Pat. No. 4,726,635 issued to Rariden, Goedken U.S. Pat. No. 4,887,873, U.S. Pat. No. 3,944,080 issued to Hansen, U.S. Pat. No. 4,236,770 issued to Moore, Alexander U.S. Pat. No. 4,049,127, U.S. Pat. No. 4,030,610 also issued to Alexander, Godfrey U.S. Pat. No. 4,176,753, U.S. Pat. No. 4,091,933 and U.S. Pat. No. 5,405,020 to Fotioo.

Pocket folders have been around for a long time, typically however, they have been designed for access from their longitudinal side, rather than top access, consistent with brief case and file drawer access. An alternative usage namely with backpacks, requires the folder to be more easily accessed thru its shorter (typically) top edge since a backpack has a narrower opening than a brief case. It would seem that merely shifting the opening on a known longitudinal file pocket would suffice, but the short dimension of the opening allows less area for the pocket to accommodate the same stack of papers which would be easy to accommodate in a traditional horizontal pocket folder. The shorter dimension allows less space to spread the puckering across and stresses all elements of the pocket leading to early failure.

Another problem with vertical filing is that the papers have a much greater tendency to fall out because the pockets do not cover as much of the paper contents as in horizontal filing. That is because if the pockets are made equally deep as in a horizontal filing, then it becomes hard to remove the papers (due to their lateral span being so much shorter) and the pockets would have to include an accordion sidewall to accommodate the deeper insertion of deep pockets. Accordion sidewalls are expensive, bulky and are less effective at frictionally retaining paper. In short, vertical file pockets present challenges not found in horizontal filing and require different solutions.

A method of manufacture is also disclosed.

The present disclosure in it various embodiments overcomes these problems.

BRIEF SUMMARY

The disclosure encompasses many embodiments. One such embodiment is detailed below in summary fashion. Please understand that this summary does not encompass the entire disclosure but is provided to assist the reader in reviewing the entire disclosure and claims which also constitute part of the disclosure.

There is disclosed file folder frame having any or all of the following: first and second frame sections having top and bottom surfaces, said sections each including a transverse segment having ends, and first and second spaced apart side longitudinal segments, each joined to said transverse segment at said transverse segment ends.

The side longitudinal segments including longitudinal shaped slots having access opening from said ends. The bottom surfaces of said first and second frame section having recesses bounded by deflectable sidewalls. The first and second frame shaped bridging rails having a profile sized to be received within said slots. There may be a plurality of wireframe leg elements having vertical and horizontal portions, at least a portion of said horizontal portions are sized to be removably received within said recesses and in biased engagement with said sidewalls.

Also disclosed is a frame wherein the recesses include flanges spanning said recesses for receiving a portion of said leg elements.

Also disclosed is a frame wherein the shaped slots and shaped rails have an L-shaped cross section.

Also disclosed is a frame wherein the said leg elements include ends and wherein each of said ends is confined between within said sidewalls and said flanges of said recesses.

Also disclosed is a frame wherein the recesses further include a stop wall vertically connecting said sidewalls and wherein said flanges horizontally connect said sidewall, so that when said leg element ends are inserted in the recesses, the leg element ends are confined against removal.

Also disclosed is a frame including friction projections in said sidewalls configured to engage said wire leg elements.

Also disclosed is a frame wherein the L shaped bridging rail has first and second generally orthogonal walls said first wall including a longitudinal folded over portion.

Also disclosed is a frame wherein the leg elements include spring bias and wherein said elements are retained in said recesses under spring bias.

Also disclosed is a frame wherein the leg elements each include first and second insertion portions being oriented generally orthogonally to each other.

Also disclosed is a frame wherein the leg elements further include vertical elements generally orthogonal to said insertion elements.

Also disclosed is a frame wherein the shaped slots in said top surface of said longitudinal segments are L-shaped and includes a sidewall with a top edge, said top edge configured to support hanging folder hooks thereon and wherein said shaped bridging rails are likewise L-shaped and include a top edge adapted to be partially coplanar with the top edge of said sidewall, so that said hooks may freely slide along either top edge.

Also disclosed is a frame wherein the top edge of said longitudinal segments has a planar portion and a sloping portion toward its distal ends.

Also disclosed is a frame wherein the transverse segment is split into two parts and includes a transverse bridging rail to join said split segments and permit width adjustment.

Also disclosed is a frame wherein the bridging rail includes a pair of spaced apart thick portions of predetermined thickness joined together by a thinner portion of thickness less than said thick portions, thereby creating a trough at said thinner portion.

Also disclosed is a method of constructing a strong lightweight adjustable frame, the frame having a pair of three sided ends and a pair of bridging rails joining the ends together to form a rectangular frame, comprising the steps of, forming said rails into an L-shape with vertical and horizontal longitudinal flanges, forming a like L-shaped slot longitudinally in said frame starting from said ends, and inserting said rail into said slot.

Also disclosed is a method further including longitudinally folder over a portion of said vertical flange.

Also disclosed is a frame for hanging folders having first and second 3-sided frame sections having top and bottom surfaces, said sections each including a transverse segment having ends, and first and second spaced apart side longitudinal segments, each joined substantially orthogonally to said transverse segment at said transverse segment ends; said side longitudinal segments including longitudinal keyhole shaped slots having access opening from said ends; said bottom surfaces of said first and second frame section having recesses bounded by sidewalls; first and second frame shaped bridging rails having a profile sized to be received within said keyhole shaped slots; a plurality of wireframe leg elements having vertical and horizontal portions, at least a portion of said horizontal portions be sized to be removably received within said recesses and in biased engagement with said sidewalls.

DETAILED DESCRIPTION

An adjustable hanging file folder frame 10 is disclosed various embodiments and will be described in detail below. A method of manufacturing same is also disclosed.

Figure 2:
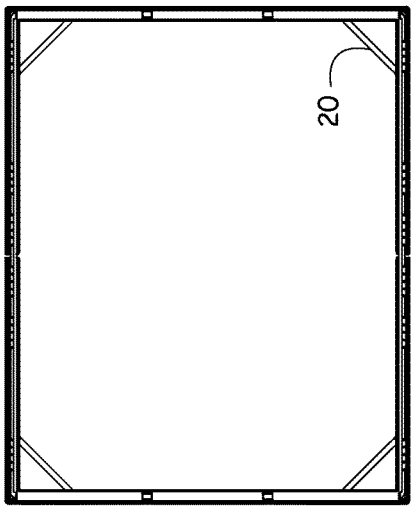
FIG. 2 is a top view of FIG. 1.
Figure 4:
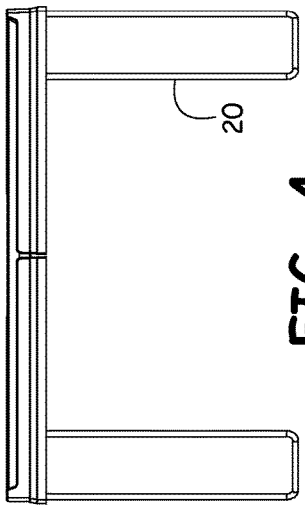
FIG. 4 is a side view of FIG. 1.
Figure 1:
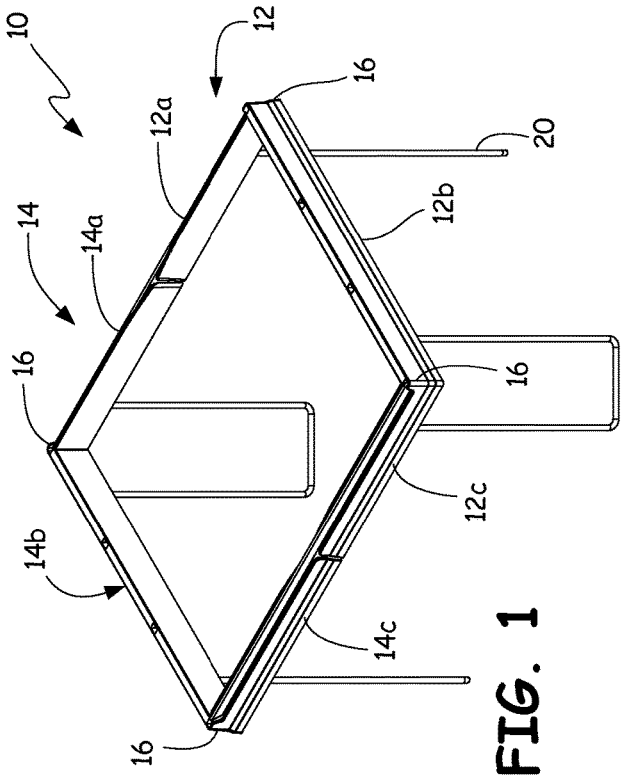
FIG. 1 is a perspective view of one embodiment of a frame.
Figure 3:
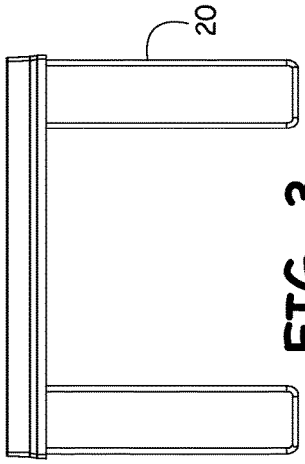
FIG. 3 is an end view of FIG. 1.
Figure 5:
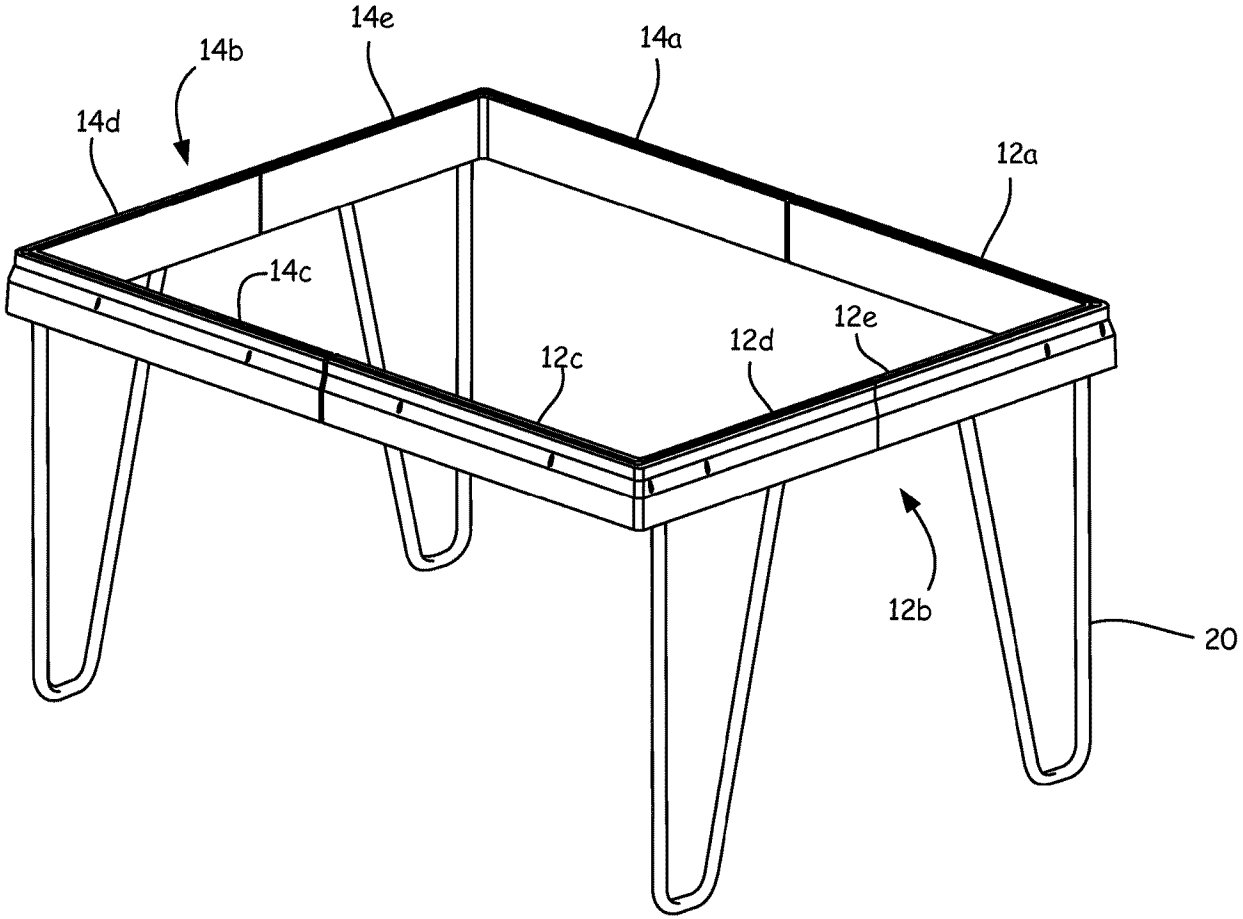
FIG. 5 is a perspective view of a further embodiment.
Figure 6:
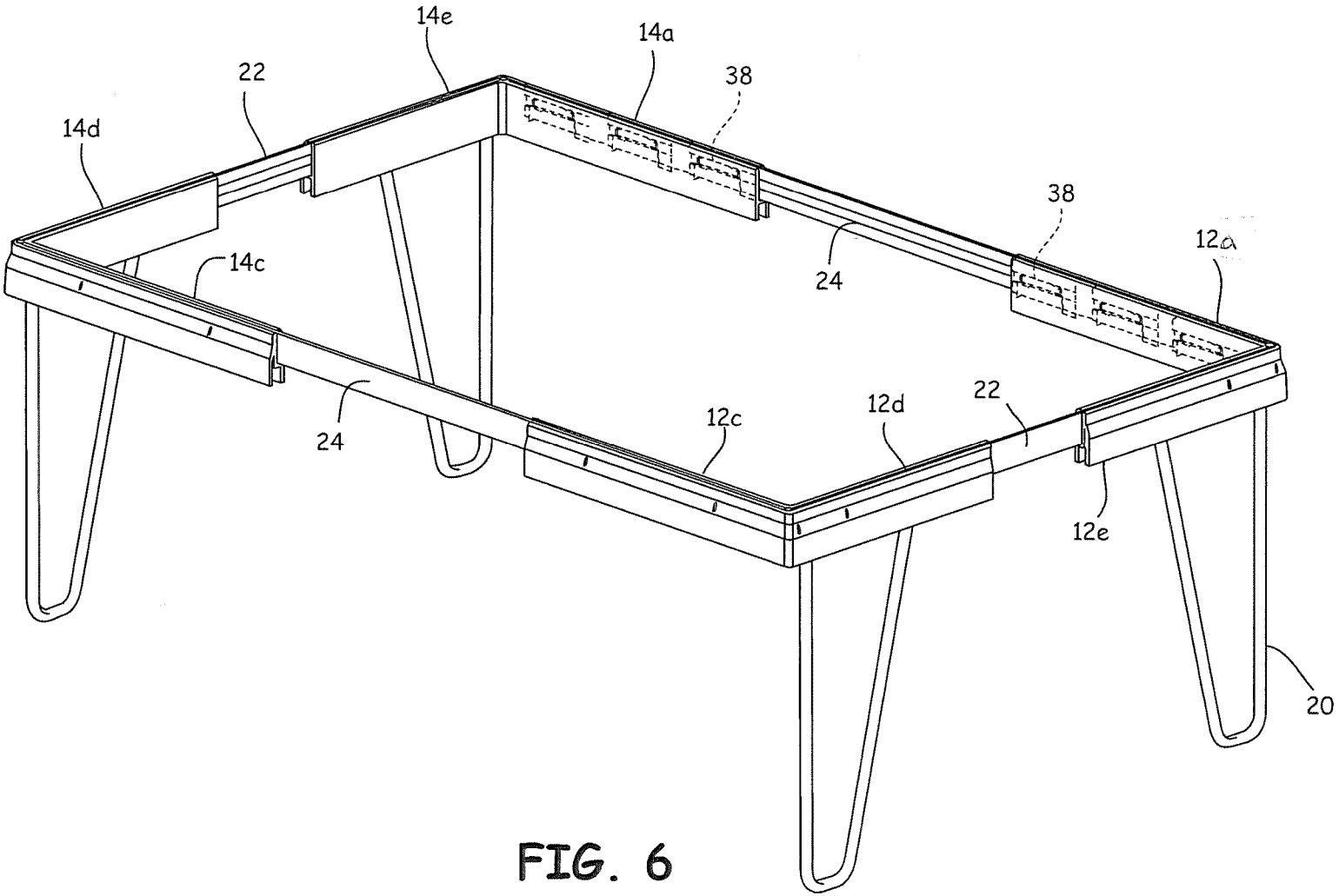
FIG. 6 is a view like FIG. 5 with width expansion capability shown.

The frame is shown in several embodiments. FIGS. 1-4 illustrate an embodiment which is longitudinally adjustable to change its length, such as for longer file drawers or cabinets, whereas FIGS. 5-6 illustrate a frame which is both longitudinally and laterally adjustable, to adapt for paper widths, such as US legal and letter sizes. Both embodiments have parts in common and thus the same references numerals are used.

Frame 10 is preferably made of two substantially identical or mirror image frame sections 12, 14 which are formed of three segments 12*a*, 12*b*, 12*c*, 14*a*, 14*b*, 14*c* where transverse (end) segments 12*b*/14*b* are joined at their ends by side segments 12*a*/12*c*, 14*a*/14*c* at corners 16.

Extending from the frame are 4 wireframe leg elements 20 whose installation will be explained below.

The embodiment in FIGS. 5-6 differs from the above in that segments 12*b* and 14*b* are further divided into two sections each 12*d*, 12*e*, 14*d*, 14*e* which are adjustably joined by bridging rails 22 which slide within the segments. Both embodiments are longitudinally adjustable by bridging rails 24, which likewise slide with segments as shown.

Figure 7:
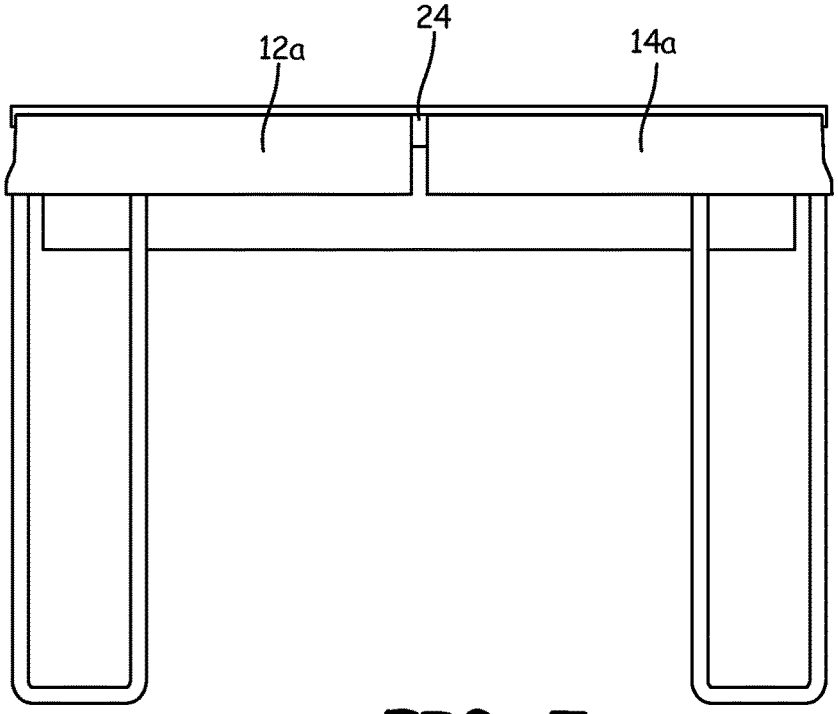
FIG. 7 is a side view of a frame.
Figure 8:
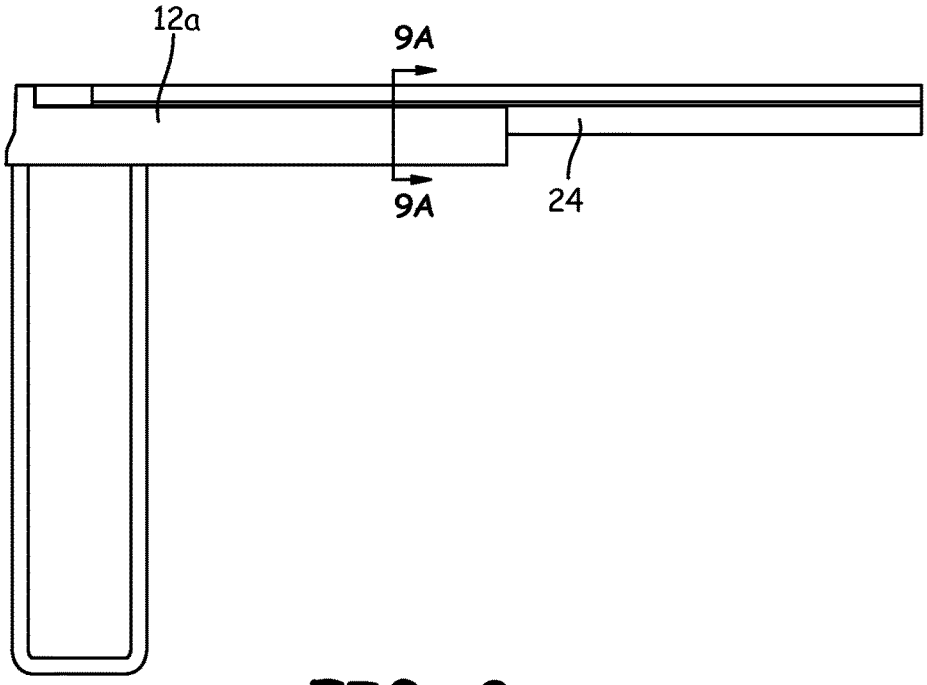
FIG. 8 is a side view of a frame with portions removed.

FIGS. 7 and 8 illustrate longitudinal segments 12*a*, 14*a* and bridging rail 24. It also illustrates a split transverse end segment 12*d*, 12*e* and bridging rail 22 for the embodiment in FIG. 6.

Figure 9A:
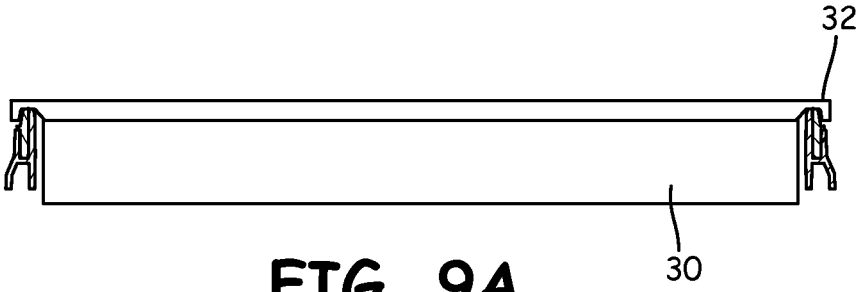
FIG. 9*a* is a side view of a portion of the frame with a hanging folder in situ.
Figure 9B:
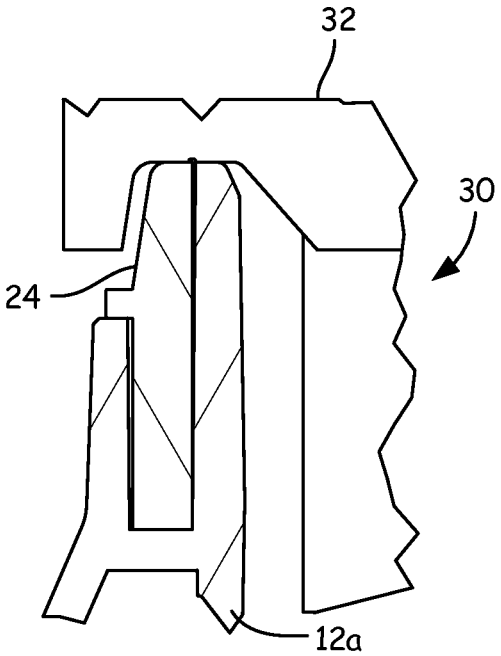
FIG. 9*b* is close up sectional view of a handing folder hook on a support frame member as shown in FIG. 9*a*.
Figure 12:
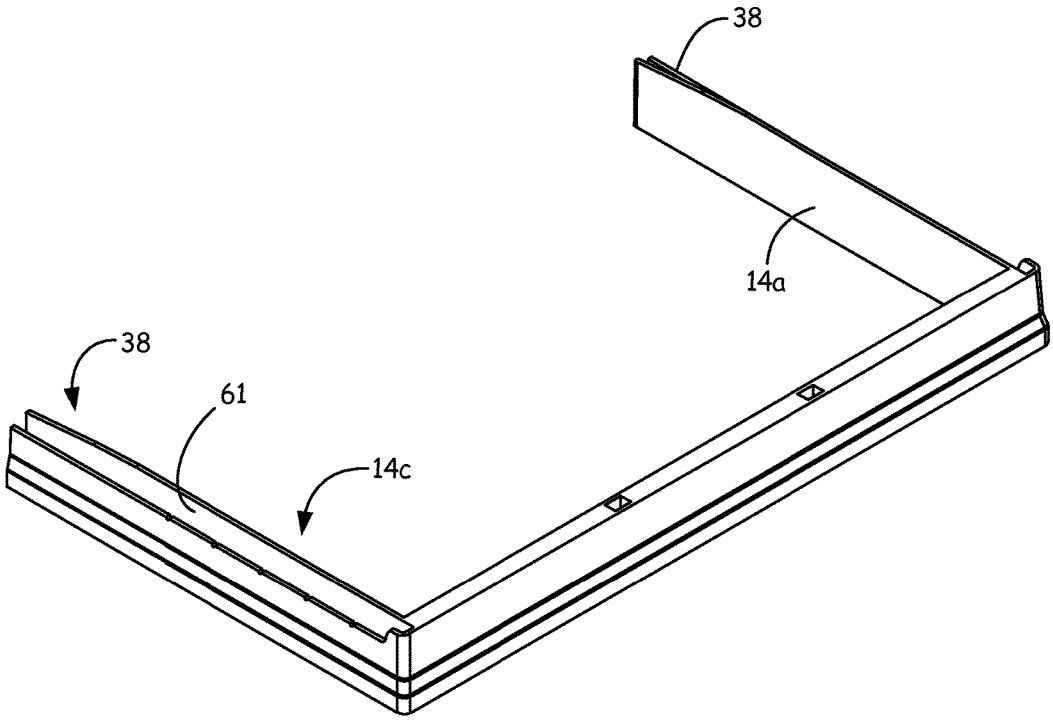
FIG. 12 is a top perspective view of a frame member.

FIGS. 9*a* and 9*b* illustrate the placement of a hanging folder 30 with hooks 32 which ride on the top edge of segments 12*a*, 12*c*, 14*a*, 14*c* and in some locations along the top edge, also rail 24. This provides for smooth gliding of the hooks over all portions of the rail or segment or both because at least a portion of where they overlap their top edge is substantially planar. In FIGS. 6 and 12, the inner sidewall of the longitudinal segment has a downwardly sloping cut away 38 as it approaches it end. This roll off from a planar portion provides an edgeless transition from where the rail 24 and the segment 14*a*/12*b* begin with a coplanar top edge, but when the segment 14*a*/12*b* ends, it has receded from being planar to being below plan of the top edge of the rail. Thus the folder hooks will not snag at the transition.

Figure 9C:
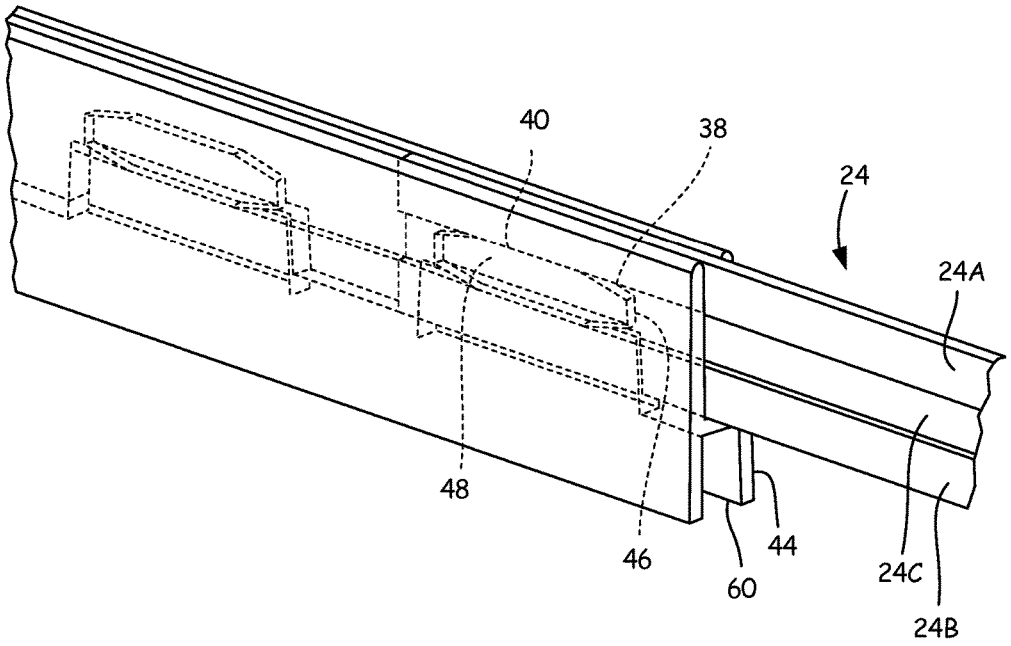
FIG. 9*c* is a close up perspective view of frame joining rail and frame member.
Figure 25:
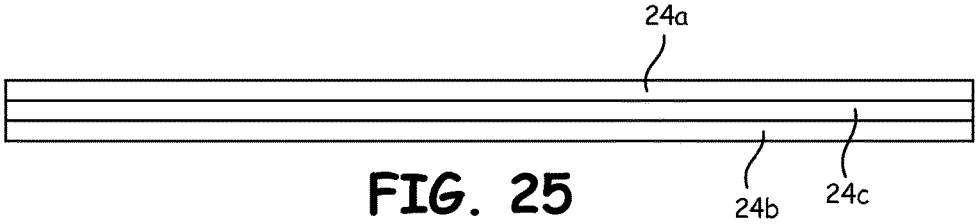
FIG. 25 is a side plan view of a further alternate frame joining rail.
Figure 26:
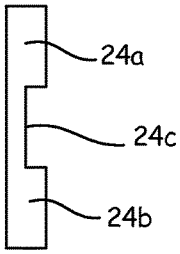
FIG. 26 is an end view of the frame joining rail of FIG. 25.
Figure 27:
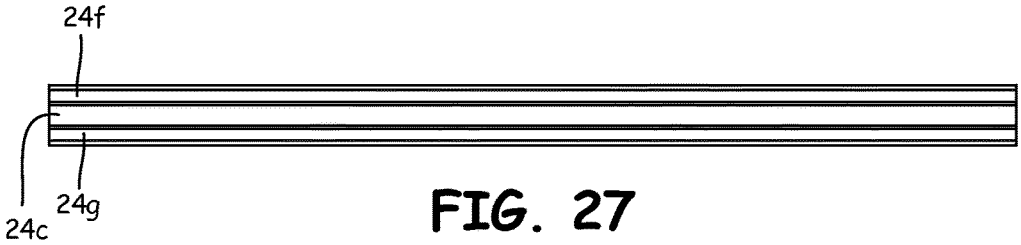
FIG. 27 is a side plan view of a still further alternate frame joining rail.

FIG. 9*c* illustrates one embodiment of a rail profile 24, shown in greater detail in FIGS. 25-26, where the rail has a pair of spaced part thick portions joined by a thinner spanning element 24*c* which creates a longitudinal recess. This longitudinal recess 24*c* provides a guide for a protruding foot 40 of the inner wall 42 of the segments 12*a, b, c, d, e* and 14*a, b, d, e*. Foot 40 resiliently protrudes from the inner wall 42 and has a curved leading edge 46 (and optionally a curved trailing edge 48) which allow the leading edge of the rail to resiliently engage and deflect the foot when inserted into the channel/keyhole slot 60 formed between the two walls 42/44. The foot is preferably made of a deflectable material or has a hinge which is bendable.

Figure 13:
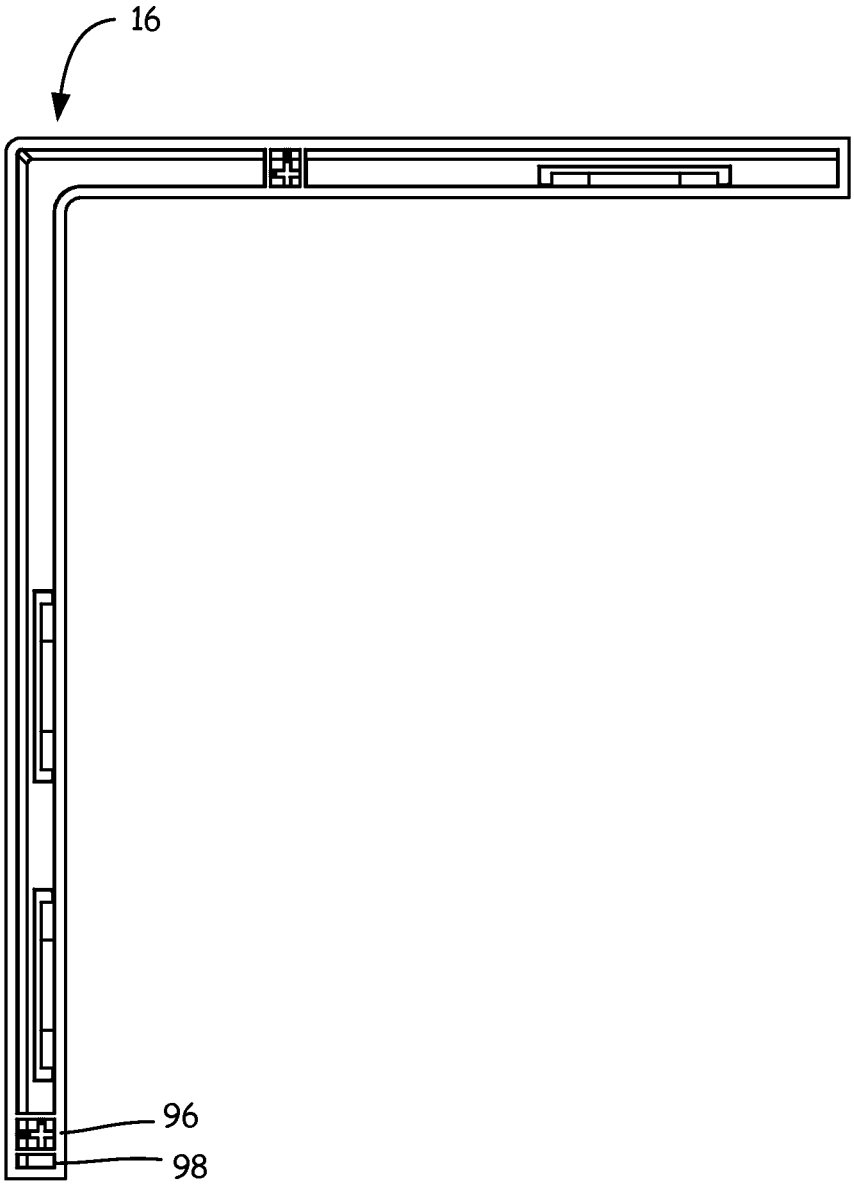
FIG. 13 is bottom plan view of a frame member.

FIG. 13 shows a bottom view of a portion of the frame.

Figure 29:
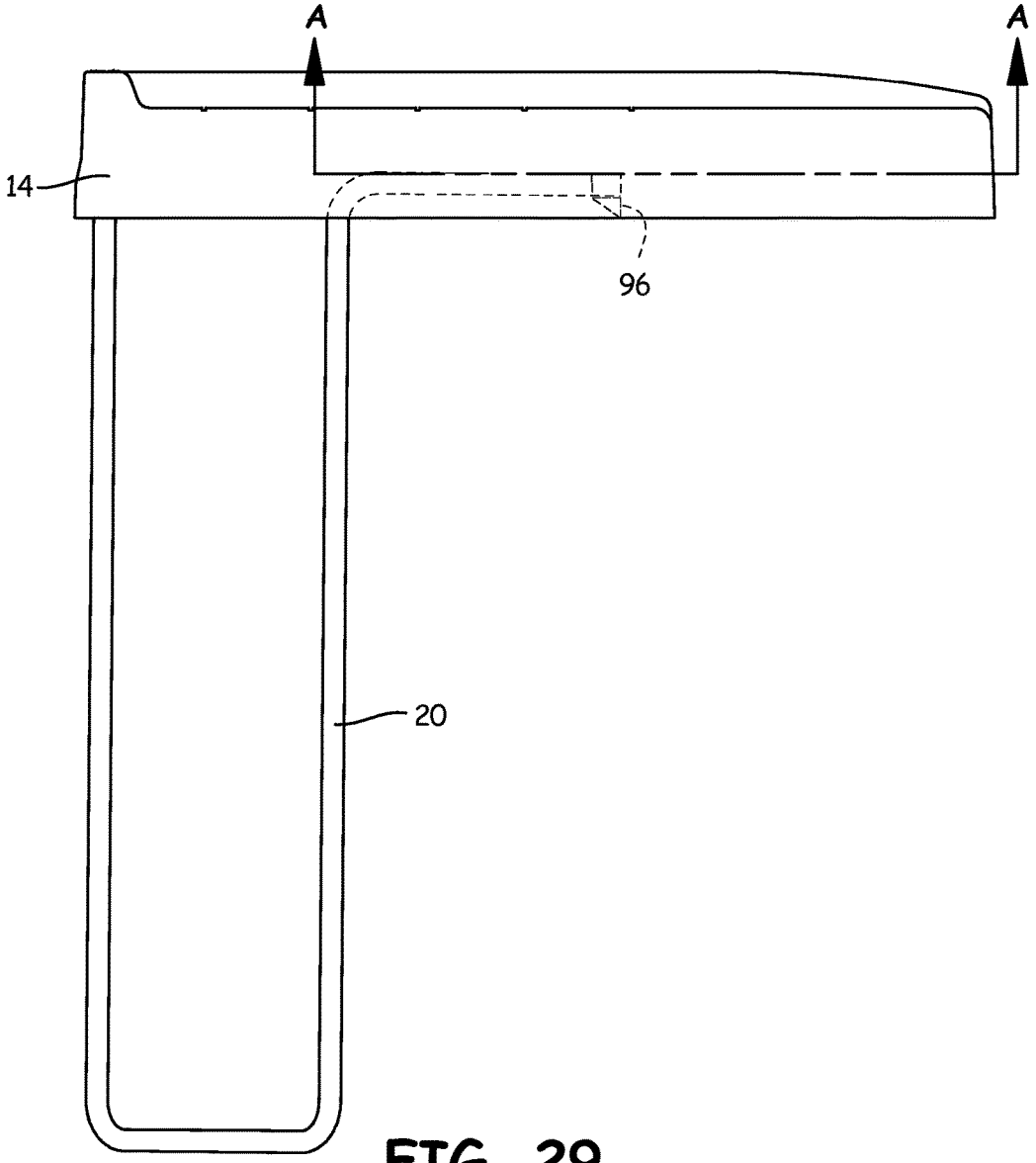
FIG. 29 is a side plan view of part of the frame and leg.

FIG. 29 is a side plan view of part of the frame and leg.

Figure 29A:
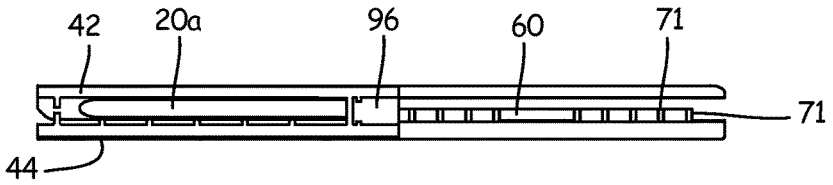
FIG. 29*a* is a view along line A-A of FIG. 29.

FIG. 29*a* is a view along line A-A of FIG. 29.

Figure 30:
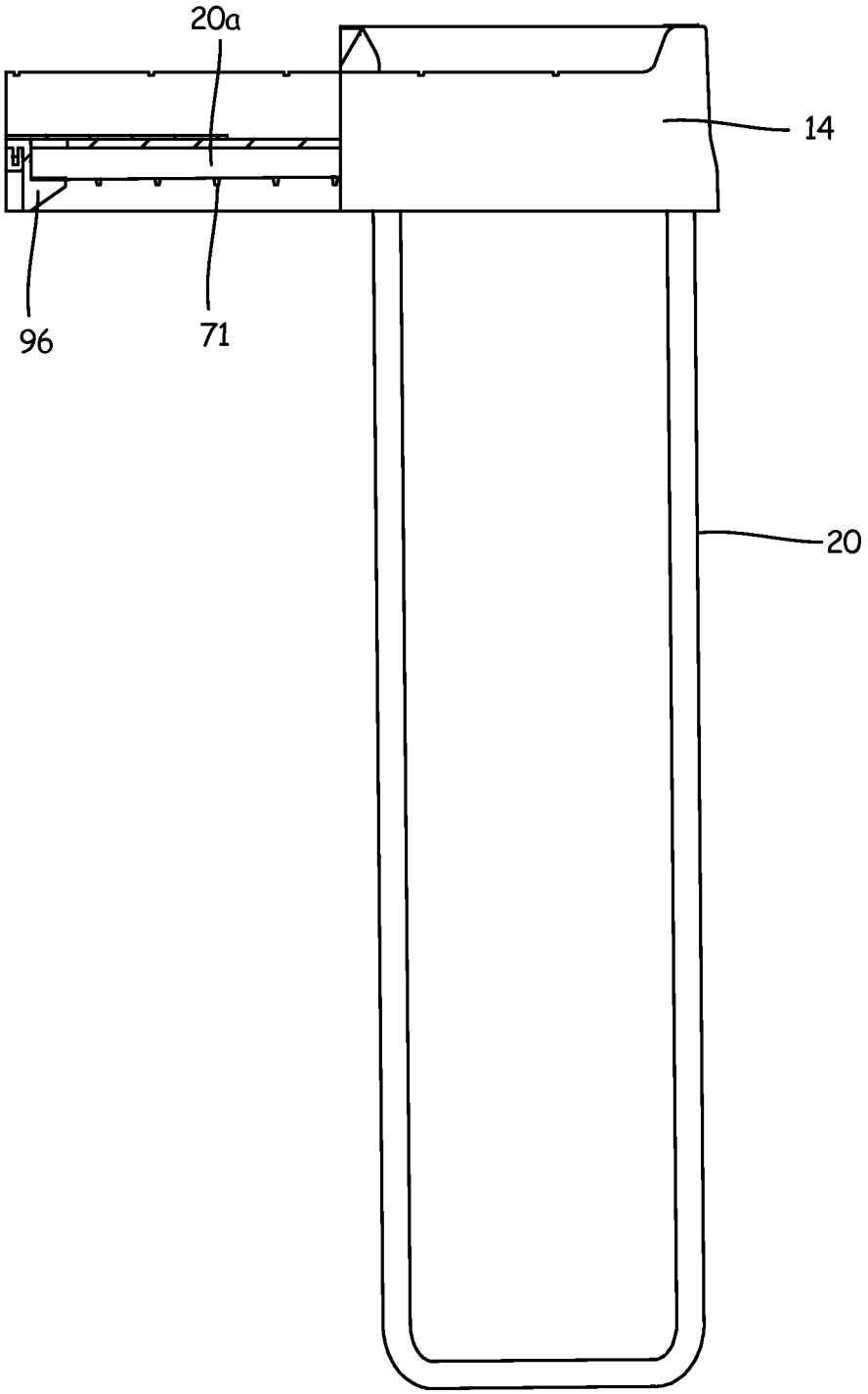
FIG. 30 is a view like FIG. 29 with portions broken away.

FIG. 30 is a view like FIG. 29 with portions broken away.

Figure 16:
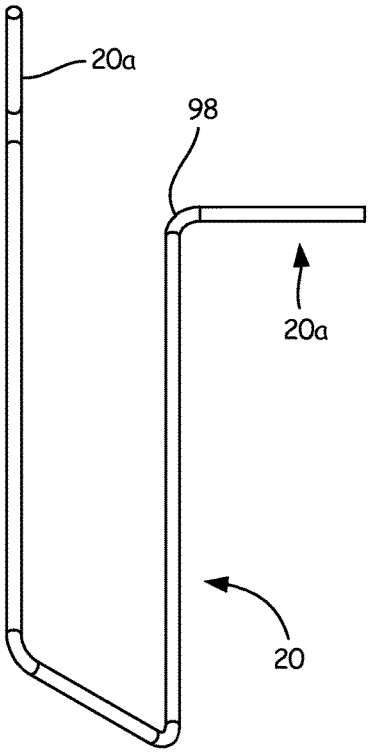
FIG. 16 is a perspective view of a wire leg member.
Figure 17:
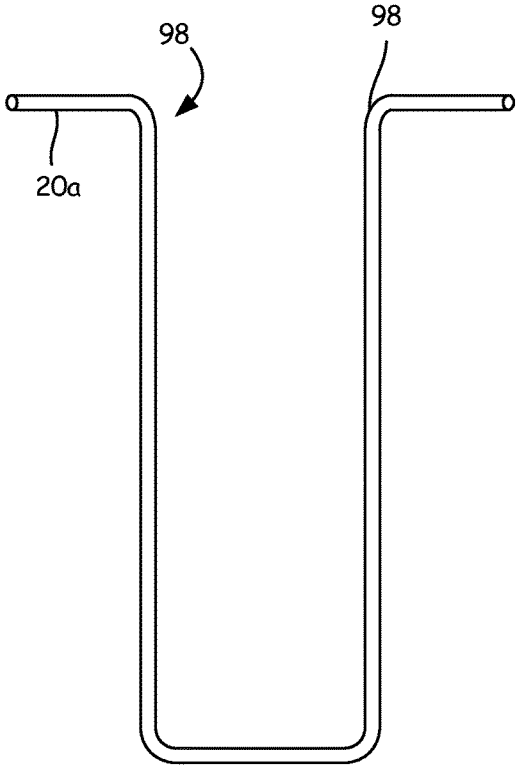
FIG. 17 is a front plan view of a wire leg member.
Figure 18:
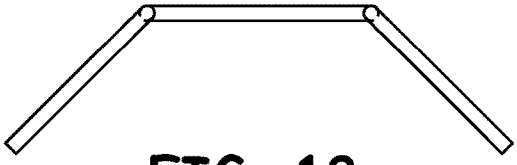
FIG. 18 is a top plan view of a wire leg member.

A longitudinal recess 60 is formed between walls 42/44 at the lower end of the segment. This provides an engagement surface for legs 20 which will be explained later. A flange 96 (FIGS. 11, 13, 29 and 30) spans at least part of the space between sidewalls 42/44 to entrap a portion of the leg 20 in the recess. There is a lever force which tends to eject the leg from the recess when the frame is loaded with folders and a barrier to angular removal is one solution to the problem. The angular force occurs when a load is applied to the frame and the corner 98 of legs 20 (see FIGS. 16-18) transmits a rotational force/torque on the bent portions 20*a* of the legs. This force attempts to extract the bent portion from remaining within the recess 60 but flange 96 blocks the extraction. A stop 98 (FIG. 13) may also be present. The stop provide a barrier to leg 20*a* sliding further along the recess. The preferred location for the stop is such that the corner 98 of the leg 20 is near but spaced from corner 16 of the frame.

To further assist the frame in maintaining the leg 20*a* in the recess, sidewalls 42/44 may include plurality of inward projecting deflectable ribs or spikes 71 on both or either inner wall of the recess (see FIG. 29) which protect into and fill a portion of the recess to restrict the passage of leg 20*a* into the deeper parts of the recess. The ribs preferably located higher in the recess so that the leg 20*a* will engage the ribs only during insertion and removal of the leg.

Figure 14:
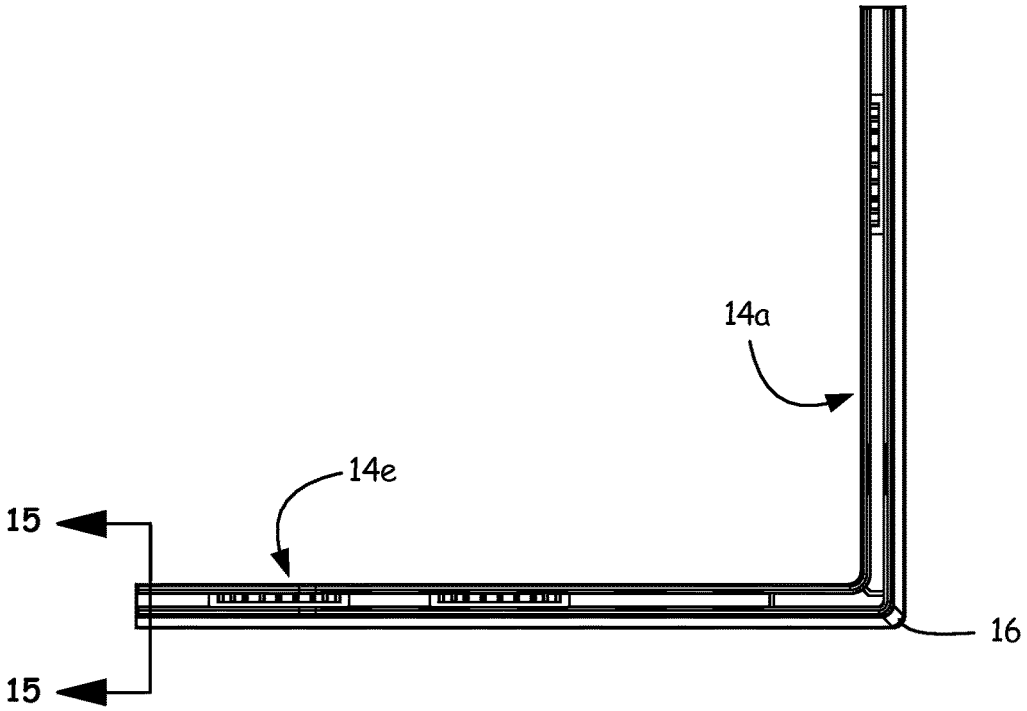
FIG. 14 is bottom plan view of a frame member
Figure 15:
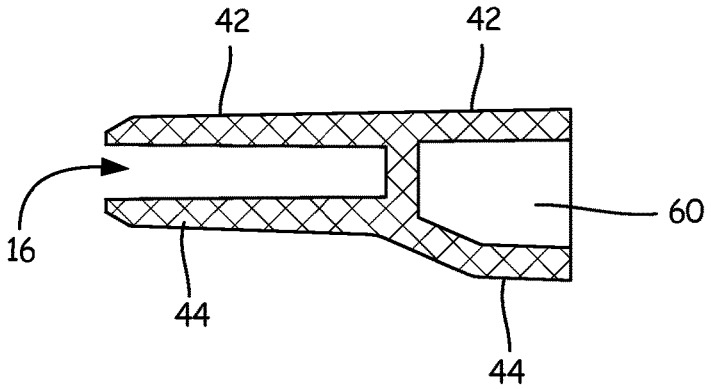
FIG. 15 is a sectional view of a frame member taken along lines A-A in FIG. 14.

FIGS. 14-15 illustrate alternate profile for the frame slots and recesses.

Figure 19:
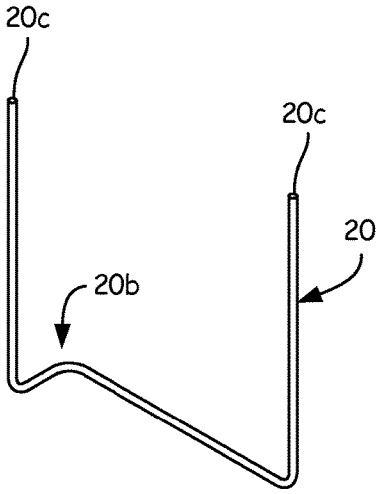
FIG. 19 is a top perspective view of an alternate wire leg member.
Figure 20:
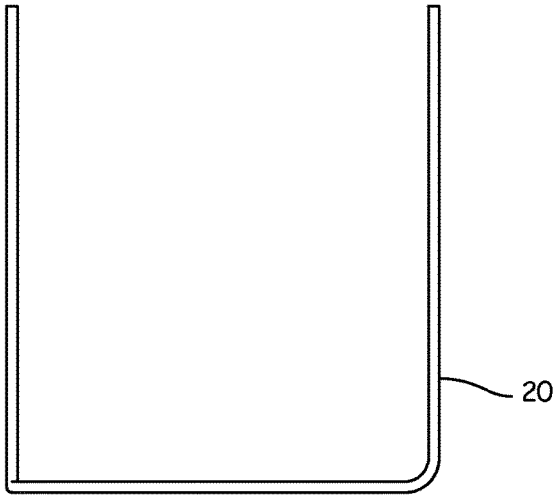
FIG. 20 is a from plan view of the leg member in FIG. 19.
Figure 21:
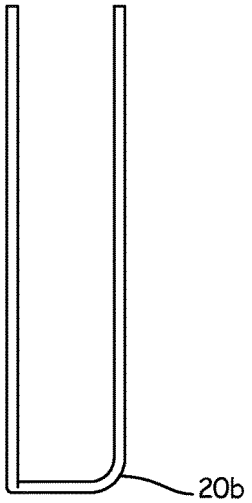
FIG. 21 is a side plan view of the leg member in FIG. 19.

FIGS. 19-21 illustrate alternate embodiments for legs 20 which include an offset bend 20*b* and whose ends 20*c* are inserted into holes in the frame (not shown) in place of the recesses.

Figure 22:
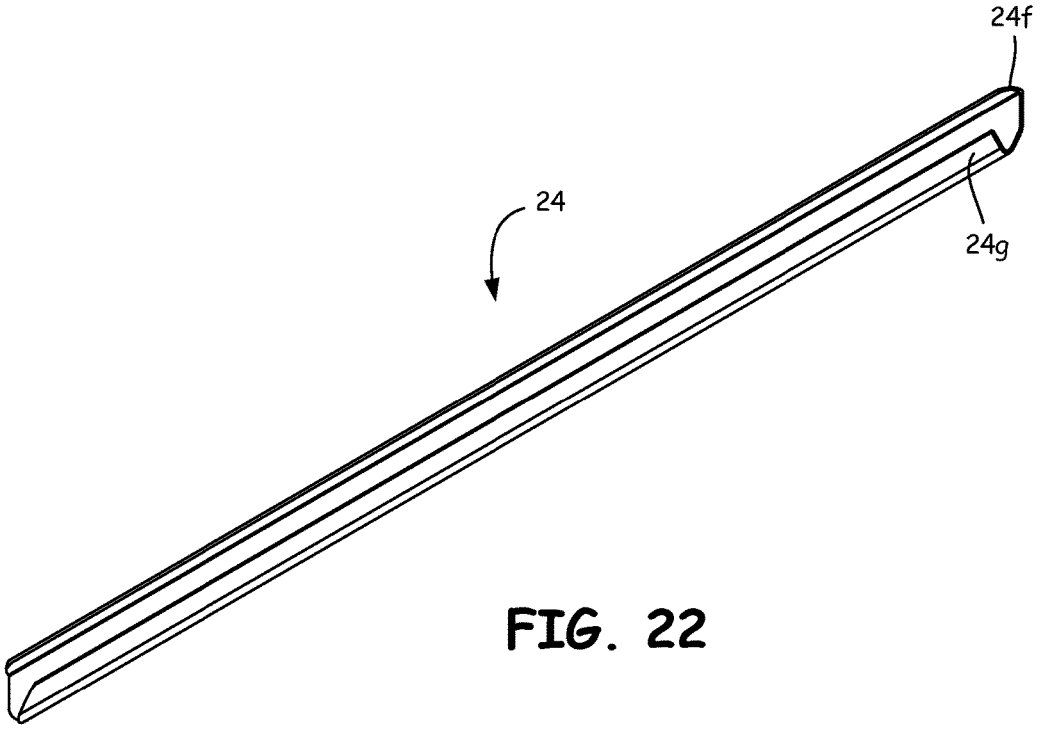
FIG. 22 is a perspective view of a frame joining rail.
Figure 28:
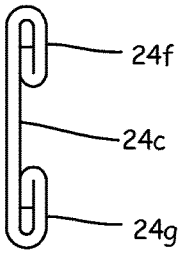
FIG. 28 is an end view of the frame joining rail of FIG. 27.

FIG. 22 illustrates an incompletely folded alternative profile for rail 24 similar to FIG. 28 wherein the edges of the rail 24*f*/24*g* are folded over for strength and to create a thickened profile.

Figure 10:
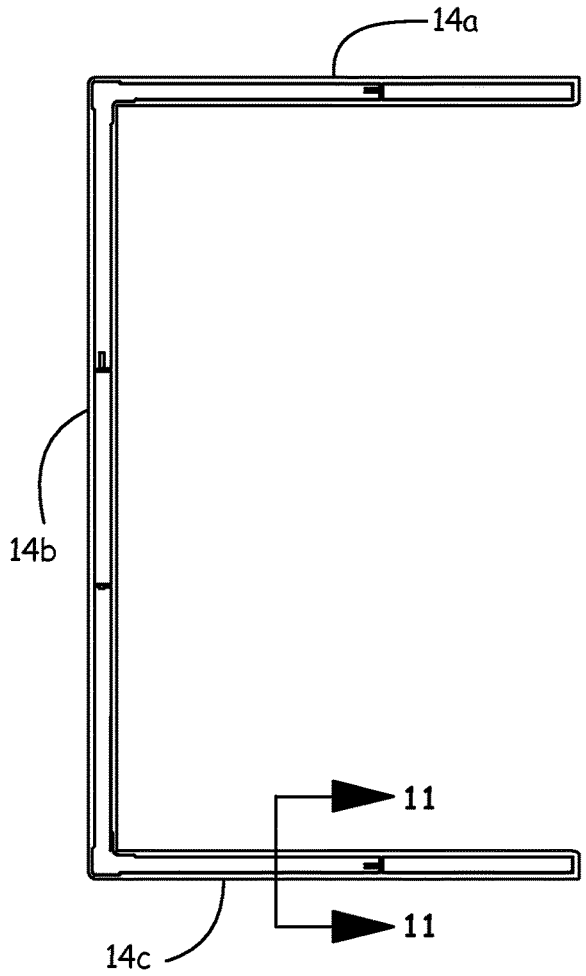
FIG. 10 is a top view of a three sided frame member.
Figure 11:
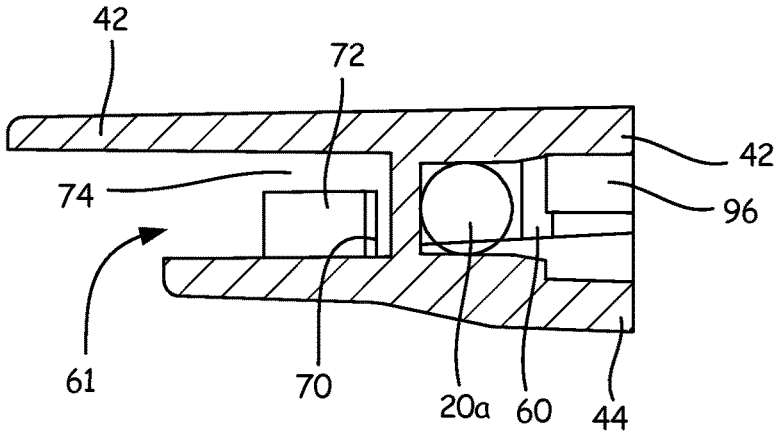
FIG. 11 is a sectional view of FIG. 10 along lines A-A in FIG. 10.
Figure 23:
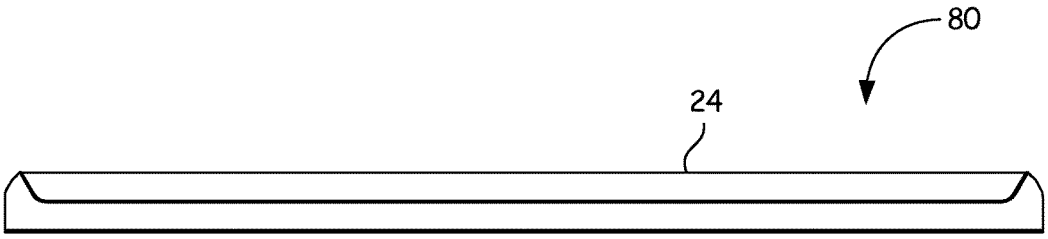
FIG. 23 is a side plan view of an alternate frame joining rail.
Figure 23A:
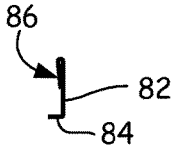
FIG. 23*a* is an end view of FIG. 23.
Figure 24:
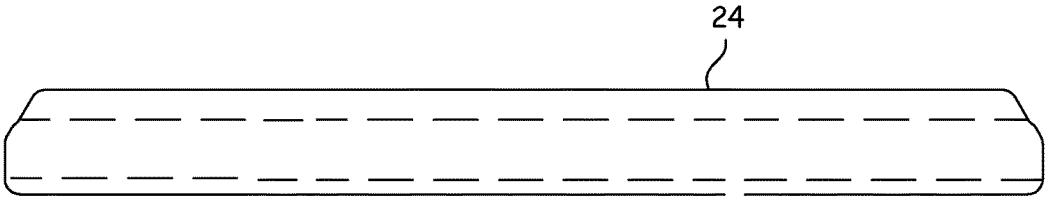
FIG. 24 is a view like FIG. 23 of the joining rail before folding.

FIGS. 10/11 illustrate the segments and a sectional profile thereof with the rail removed but part of leg 20*a* shown. Slot 61 is formed in the space between walls 42/44. Slot 61 has a predetermined formed profile which mates with the profile of the rail. Several profiles are possible, such as L-shaped, created by a protrusion 72 in slot 61 thereby forming a stop wall as an orthogonally intersecting passage 70/74 at the protrusion. FIG. 25 illustrated a L-shaped rail 80 having a narrower leg 84 sized to be received in passage 70, a taller leg 82 sized to be received in passage 70 and a folded over portion 86 of leg 82 which provides strength to the rail. See FIG. 23*a*. FIG. 24 shows the rail in a flat pre-bent shape.

There is also disclosed a method of making an adjustable frame for hanging folder. A frame for hanging folders using any or all of the following steps in any order:

a. forming two frame section, which themselves are formed of three orthogonally joined elements (or in the case of 4 sided adjustable frame, there are 4 frame sections of two orthogonal sides—see FIG. 6);

b. forming first and second frame parallel elements to have longitudinal shaped slots having access opening from their ends;

c. forming the parallel elements to have recesses bounded by deflectable sidewalls;

d. forming bridging rails to have a profile sized to be received within said slots; typically the profile be L-shaped or have a ridge and recess to mate with the like L shape or ridge/recess of the element, thereby being adjustably received therein;

e. forming a plurality of wireframe leg elements having vertical and horizontal portions, at least a portion of said horizontal portions be sized to be removably received within said recesses and in biased engagement with said sidewalls;

f. forming a transverse flange between the sidewalls to prevent the leg portion from being ejected under downward force being applied to the frame.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A frame for hanging folders comprising:

a. first and second frame sections having top and bottom surfaces, said sections each including a transverse segment having ends, and first and second spaced apart side longitudinal segments, each joined to said transverse segment at said transverse segment ends;

b. said side longitudinal segments including longitudinal shaped slots having access opening from said ends;

c. said bottom surfaces of said first and second frame section having recesses bounded by deflectable sidewalls;

d. first and second frame shaped bridging rails having a profile sized to be received within said slots;

e. a plurality of wireframe leg elements having vertical and horizontal portions, at least a portion of said horizontal portions sized to be removably received within said recesses and in biased engagement with said sidewalls.

2. The frame of claim 1 wherein said recesses include flanges spanning said recesses for receiving a portion of said leg elements.

3. The frame of claim 1 wherein each of said longitudinal shaped slots and frame shaped rails have an L-shaped cross section.

4. The frame of claim 3 wherein said leg elements include ends and wherein each of said ends is confined between said sidewalls and said flanges of said recesses.

5. The frame of claim 4 wherein said recesses further include a stop wall vertically connecting said sidewalls and wherein said flanges horizontally connect said sidewall, so that when said leg element ends are inserted in the recesses, the leg element ends are confined against removal.

6. The frame of claim 1 further including friction projections in said sidewalls configured to engage said wireframe leg elements.

7. The frame of claim 1 wherein each said frame shaped bridging rail has first and second generally orthogonal walls, said first wall including a longitudinal folded over portion.

8. The fame of claim 1 wherein said leg elements include spring bias and wherein said elements are retained in said recesses under said spring bias.

9. The frame of claim 1 wherein said leg elements each include first and second insertion portions being oriented generally orthogonal to each other.

10. The frame of claim 9 wherein said leg elements further include vertical elements generally orthogonal to said insertion elements.

11. The frame of claim 1 wherein said longitudinal shaped slots in said top surface of said longitudinal segments are L-shaped and each includes a sidewall with a top edge, said top edge configured to support hanging folder hooks thereon and wherein said frame shaped bridging rails are L shaped and include a top edge adapted to be partially coplanar with the top edge of said sidewall, so that said hooks are free to slide along either top edge.

12. The frame of claim 11 wherein the top edge of said longitudinal segments has a planar portion and a sloping portion toward the distal ends of the segments.

13. The frame of claim 1 wherein each said transverse segment is formed in at least two parts thereby forming split segments and includes a transverse bridging rail to join said split segments and permit width adjustment.

14. The frame of claim 1 wherein each said bridging rail includes a pair of spaced apart first portions of predetermined thickness joined together by a second portion of thickness less than said first portions, thereby creating a trough at said second portion.

15. A frame for hanging folders comprising:

a. first and second 3-sided frame sections having top and bottom surfaces, said sections each including a transverse segment having ends, and first and second spaced apart side longitudinal segments, each joined substantially orthogonally to said transverse segment at said transverse segment ends;

b. said side longitudinal segments including longitudinal keyhole shaped slots having access opening from said ends;

c. said bottom surfaces of said first and second frame sections having recesses bounded by sidewalls;

d. first and second frame shaped bridging rails having a profile sized to be received within said keyhole shaped slots;

e. a plurality of wireframe leg elements having vertical and horizontal portions, at least a portion of said horizontal portions sized to be removably received within said recesses and in biased engagement with said sidewalls.

* * * * *